United States Patent [19]

Shinozaki et al.

[11] Patent Number: 4,571,598

[45] Date of Patent: Feb. 18, 1986

[54] THERMAL HEAD

[75] Inventors: Michio Shinozaki; Kaneki Yoshida, both of Tokyo, Japan

[73] Assignee: Toppan Printing Co., Ltd., Japan

[21] Appl. No.: 577,049

[22] Filed: Feb. 6, 1984

[30] Foreign Application Priority Data

Feb. 8, 1983 [JP] Japan ..... 58-19162

[51] Int. Cl.[4] ..... B41J 3/20

[52] U.S. Cl. ..... 346/76 PH; 219/543; 219/216

[58] Field of Search ..... 357/81, 70, 75; 219/216 PH, 216, 538, 539, 542, 543; 346/76 PH, 76 R; 400/120

[56] References Cited

U.S. PATENT DOCUMENTS 4,394,092 7/1983 Osmera et al. ..... 219/216 PH

*Primary Examiner*—E. A. Goldberg
*Assistant Examiner*—A. Evans
*Attorney, Agent, or Firm*—Lerner, David, Littenberg, Krumholz & Mentlik

[57] ABSTRACT

A thermal head for a thermal printer or a thermal transfer printer wherein a substrate linearly formed with a plurality of heating elements and a control substrate for controlling generation of heat of the heating elements are mounted on different surfaces of a heat sink having a certain angle therebetween, whereby the printing mechanism can be simplified and compact in construction. Particularly, where the thermal head is applied to a multicolor recording apparatus, it is possible to increase the recording speed and miniaturize the apparatus.

10 Claims, 14 Drawing Figures

THERMAL HEAD

FIELD OF THE INVENTION

The present invention relates to a thermal head used for a thermal printer or a thermal transfer printer, and more particularly, to a thermal head suitable for a thermal printer or a thermal transfer printer for multicolor recording.

BACKGROUND OF THE INVENTION

In a thermal head 107 for a thermal printer or a thermal transfer printer heretofore available, both a ceramic substrate 2-*a* linearly formed with a plurality of dot-like heating elements 4 and a ceramic substrate 2-*b* provided with a heating element control circuit 5 and an external connecting terminal 5-*a* adhered to one surface of a heat sink 101 formed of metal, with the control circuit 5 covered with and protected by a cover 3 as shown in FIG. 1. In such a thermal head 107, an area occupied by the heating element control circuit 5 portion is larger than a portion linearly formed with a plurality of heating elements 4, as a consequence of which the printing mechanism inevitably becomes large-sized. Also, as shown in FIG. 2, the cover 3 has to be provided on the portion of the heating element control circuit 5 and, therefore, rugged portions are formed on the heating element forming surface. Therefore, the printing mechanism is complicated because a number of guide rollers 15 are used and requires a wide space for supplying and discharging a thermal transfer sheet 11 and a recording paper 10 during the thermal transfer printing into and between a platen roller 8 and the thermal head 107. As a consequence, during thermal transfer printing, it becomes difficult to accommodate the transfer sheet 11 into a compact cassette, and therefore, the thermal transfer sheet cannot be easily replaced and in addition, troubles such as wrinkles or twists in the thermal transfer sheet tend to occur. In FIG. 2, a reference numeral 9-*a* designates a thermal transfer sheet drawing-out roll, and 9-*b* thermal transfer sheet winding roll.

Where multicolor thermal transfer printing is intended to be carried out by using the above-described prior art thermal head there has been contemplated methods, one wherein a number of mechanisms as shown in FIG. 2 are provided for as many colors as are required, and the other wherein dividedly or divisionally multi-colored thermal transfer sheets are used, and a single mechanism is repeatedly used the same number of times as that of the colors required. In the former method, a considerable space is required and therefore, it is not practical. The latter method has a disadvantage in that the time necessary for recording increases proportionally to an increase in the number of colors. This disadvantage similarly occurs in the case of the other thermal printers.

To cope with the disadvantage noted above, there has been known a thermal head 104 in which a linear heating element 4 is formed at the end of a substrate 102, and wiring patterns 103 from the heating element 4 are formed at both sides of the substrate 102, as shown in FIG. 3. However, this thermal head 104 is not provided with a control circuit on the substrate 102, and therefore, the same number of wires as that of dots of the heating elements have to be taken out of the substrate 102 in order to connect them to a control device separately installed, for example, by a flexible cable. The number of wires amounts to 840 for A4 Format (210 mm) for even a thermal head of coarse density which is about 4 dots per 1 mm. A flexible cable or the like has to be provided for that purpose and a considerable space is required accordingly, thus making it difficult to make the thermal head smaller in size. In addition, it has been heretofore difficult to produce a thermal head of high dot density in terms of manufacturing technique and a thermal head of good performance has not bee obtained.

OBJECTS OF THE INVENTION

The present invention has been achieved in view of the prior art noted above. It is an object of the invention to provide a thermal head which can reduce the space necessary for a printing mechanism in a thermal printer or a thermal transfer printer to miniaturize the whole apparatus.

It is a further object of the present invention to provide a thermal head which is most suitable for a thermal printer or a thermal transfer printer which performs multicolor recording.

It is another object of the present invention to provide a thermal head in which a thermal transfer sheet used in the thermal transfer printer is formed into a cassette so that the thermal transfer sheet may be easily replaced.

SUMMARY OF THE INVENTION

To achieve the aforementioned objects, the present invention provides a thermal head used for a thermal printer or a thermal transfer printer characterized in that a substrate linearly formed with a plurality of heating elements and a substrate formed with a control circuit for controlling generation of heat resulting from energization and deenergization of said heating elements are respectively mounted on different surfaces having a certain angle.

DETAILED DESCRIPTION OF THE INVENTION

Figure 1:
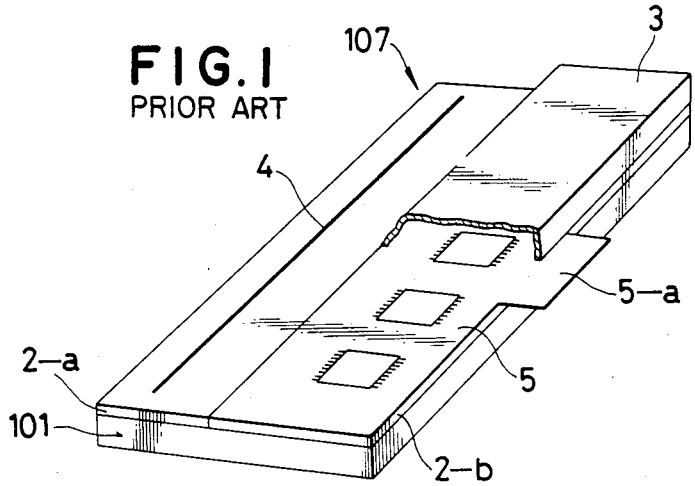
FIG. 1 PRIOR ART
FIG. 1 is a perspective view of a conventional thermal head.
Figure 2:
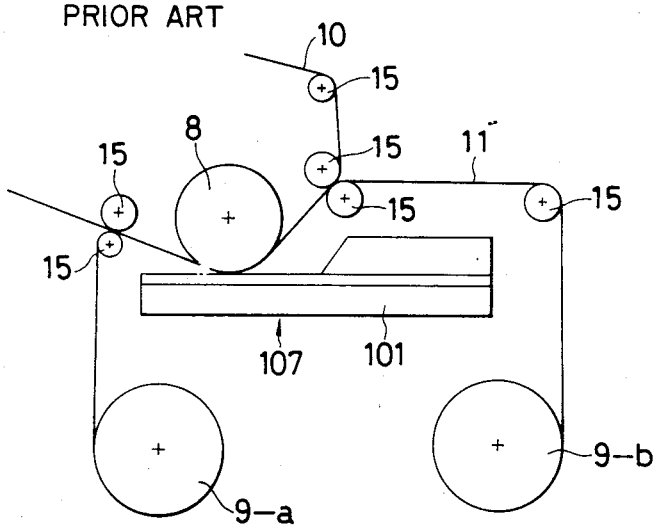
FIG. 2 PRIOR ART
FIG. 2 is an explanatory view showing an example of use of the thermal head shown in FIG. 1.
Figure 3:
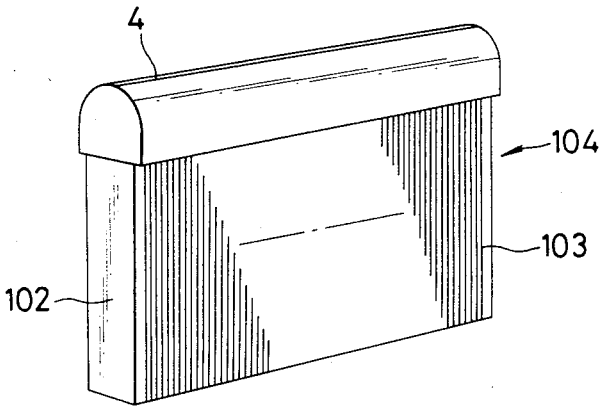
FIG. 3 PRIOR ART
FIG. 3 is a perspective view of a further conventional thermal head.

The present invention will be described hereinafter in connection with embodiments shown in the accompanying drawings.

Throughout the drawings, parts indicated by the same reference numerals are those identical therewith.

Figure 4:
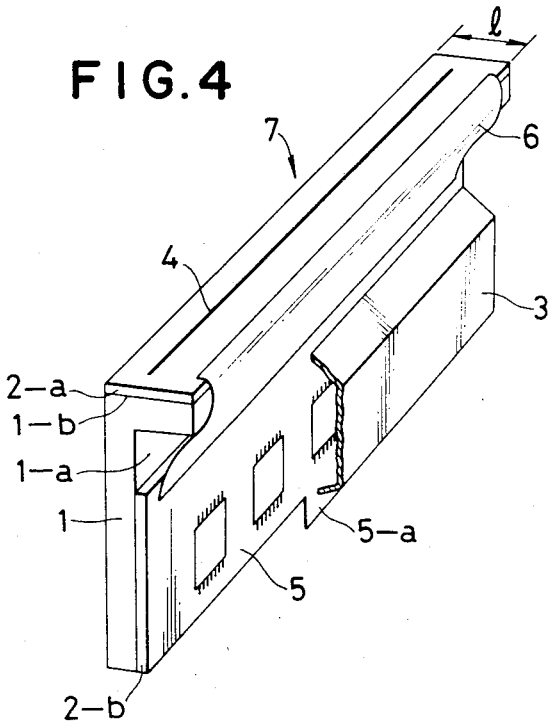
FIG. 4 is a perspective view of one embodiment of a thermal head in accordance with the present invention.

FIG. 4 is a perspective view showing one embodiment of a thermal head 7 in accordance with the present invention. A reference numeral 1 designates a heat sink made of metal such as iron, and reference numerals 2-*a* and 2-*b* designate a ceramic substrate. The heat sink 1 is formed into an L-shape, and the substrate 2-*a* is adhered to a bottom surface 1-*b* thereof. The substrate 2-*b* is adhered to a surface 1-*a* internally of the L-shape formed at approximately 90° with respect to the bottom surface 1-*b*. A number of heating elements 4 are linearly arranged on one substrate 2-*a*, and on the other substrate 2-*b* is formed a heating element control circuit 5 for controlling energization and deenergization relative to the heating elements 4 to generate an information recording signal which selectively heats the heating elements 4. The heating elements 4 can be formed of Ni—Cr, Ta—Si, Ta—$SiO_2$, TaN, $Ta_2N$, etc, which are well known.

A reference numeral 3 designates a protective cover for the control circuit formed of metal, plastics or the like, the protective cover being shown in FIG. 4 with a part thereof cutaway. A reference numeral 6 designates a flexible cable which electrically connects the heating elements 4 linearly arranged on the substrate 2-*a* with the control circuit 5 arranged on the substrate 2-*b*.

Figure 5:
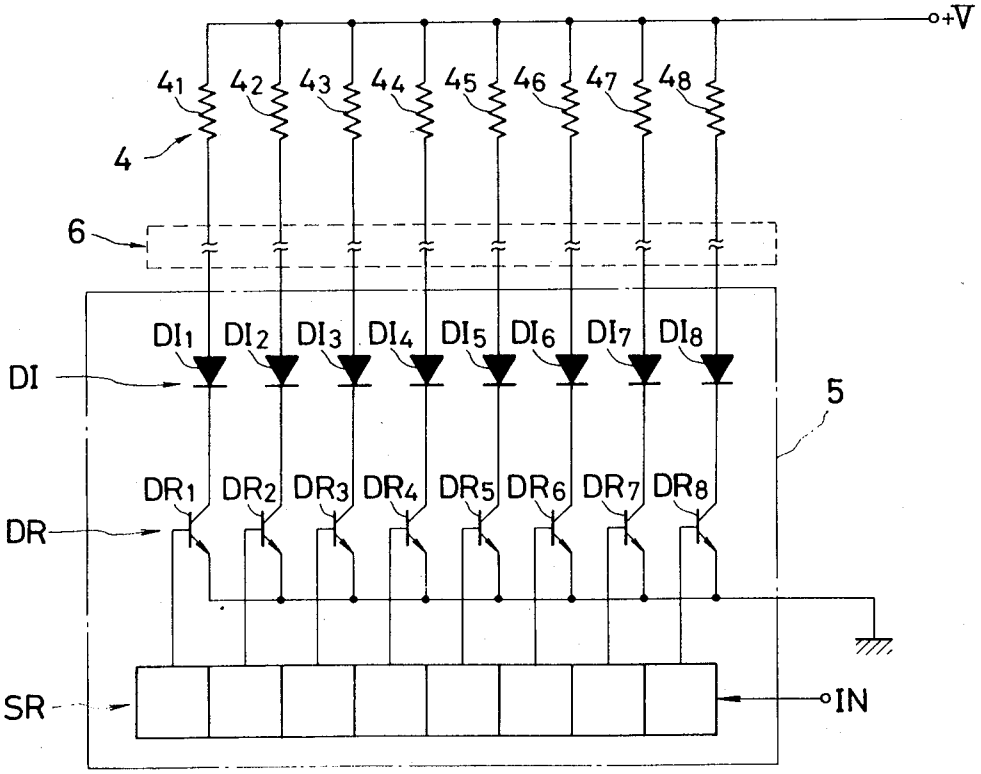
FIG. 5 shows one example of an electric circuit of a thermal head shown in FIG. 4.

FIG. 5 shows one example of an electric circuit for driving the thermal head shown in FIG. 4. Heating elements $4_1$, $4_2$, . . . $4_8$ are connected at one end to a common power source and at the other end to diodes $DI_1$, $DI_2$, . . . $DI_8$, respectively, through the flexible cable 6. The diodes $DI_1$, $DI_2$, . . . $DI_8$ are further connected to collector electrodes of drivers $DR_1$, $DR_2$, . . . $DR_8$, respectively, and emitter electrodes of the drivers $DR_1$, $DR_2$, . . . $DR_8$ are grounded. Base electrodes of the drivers $DR_1$, $DR_2$, . . . $DR_8$ are connected to a shift register SR, and recording signals are put into the shift register. The control circuit 5 comprising these diodes DI, drivers DR, shift register SR and the like is formed on the substrate 2-*b* as previously described. In such a circuit construction, when a recording signal indicative of which heating element among the heating elements $4_1$, $4_2$, . . . $4_8$ is heated is put into the shift register SR, a cell of the shift register SR corresponding to the heating element to be heated assumes a high level, and the gate of the driver connected to the cell opens whereby an electric current flows into the heating element connected to the driver whose gate was opened to heat the heating elements.

While the heating elements $4_1$, $4_2$, . . . $4_8$ can be selectively heated in a manner as described above, it is noted that the electric circuit of the present invention is not limited to the above-described embodiment.

The thermal head in the present embodiment is designed so that the heat sink 1 is formed into an L-shape, and only the substrate 2-*a* formed with the heating elements is mounted on the bottom surface 1-*b* thereof, as a consequence of which the surface formed with the heating elements is flat; and the substrate 2-*b* formed with the control circuit is mounted on the surface 1-*a* internally of the L-shape formed at approximately 90° with respect to the bottom surface 1-*b*, and the flexible cable 6 is used for electrical connection of both the heating element 4 and the control circuit 5. Therefore, even if the protective cover 3 is provided, the width of the whole thermal head 7 can be made into a compact configuration substantially equal to the width l of the substrate 2-*a* formed with the heating elements.

Figure 6:
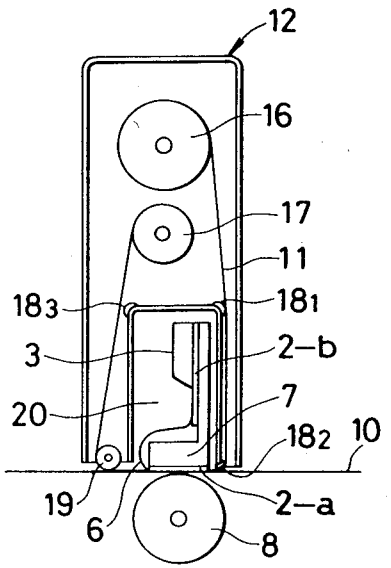
FIG. 6 is an explanatory view showing an example of use of the thermal head shown in FIG. 4.

FIG. 6 shows one example of a printing mechanism where the thermal head 7 of the present invention is applied to a thermal transfer printer.

In accordance with this embodiment, a thermal transfer sheet 11 is received within a cassette 12, drawn out of a drawing-out roller 16 provided interiorly of the cassette 12, passed over a guide corner $18_2$ formed of a low friction material at the bottom of the cassette 12 and a guide roller 19, and wound on a winding roller 17. The thermal head 7 is designed so that it is received in a space 20 which extends in a direction perpendicular to a paper surface provided at the lower portion of the cassette 12. The thermal transfer sheet 11 and a recording paper 10 are present in close contact with each other between a heating element forming surface of the thermal head 7 and a platen roller 8. In the figure, reference numerals $18_1$ and $18_2$ denote guide corners formed of a low frictional material. In this mamnner, the heat sink 1 of the thermal head 7 is formed into an L-shape, and the heating element forming substrate 2-*a* in contact with the thermal transfer sheet an the heating element control circuit forming substrate 2-*b* are positioned at different surfaces having an angle of approximately 90°, and therefore, the thermal transfer sheet can be received into the cassette and the printer can be formed very compactly.

The effectiveness of the present invention is more conspicuous in the case of multicolor recording.

Figure 7:
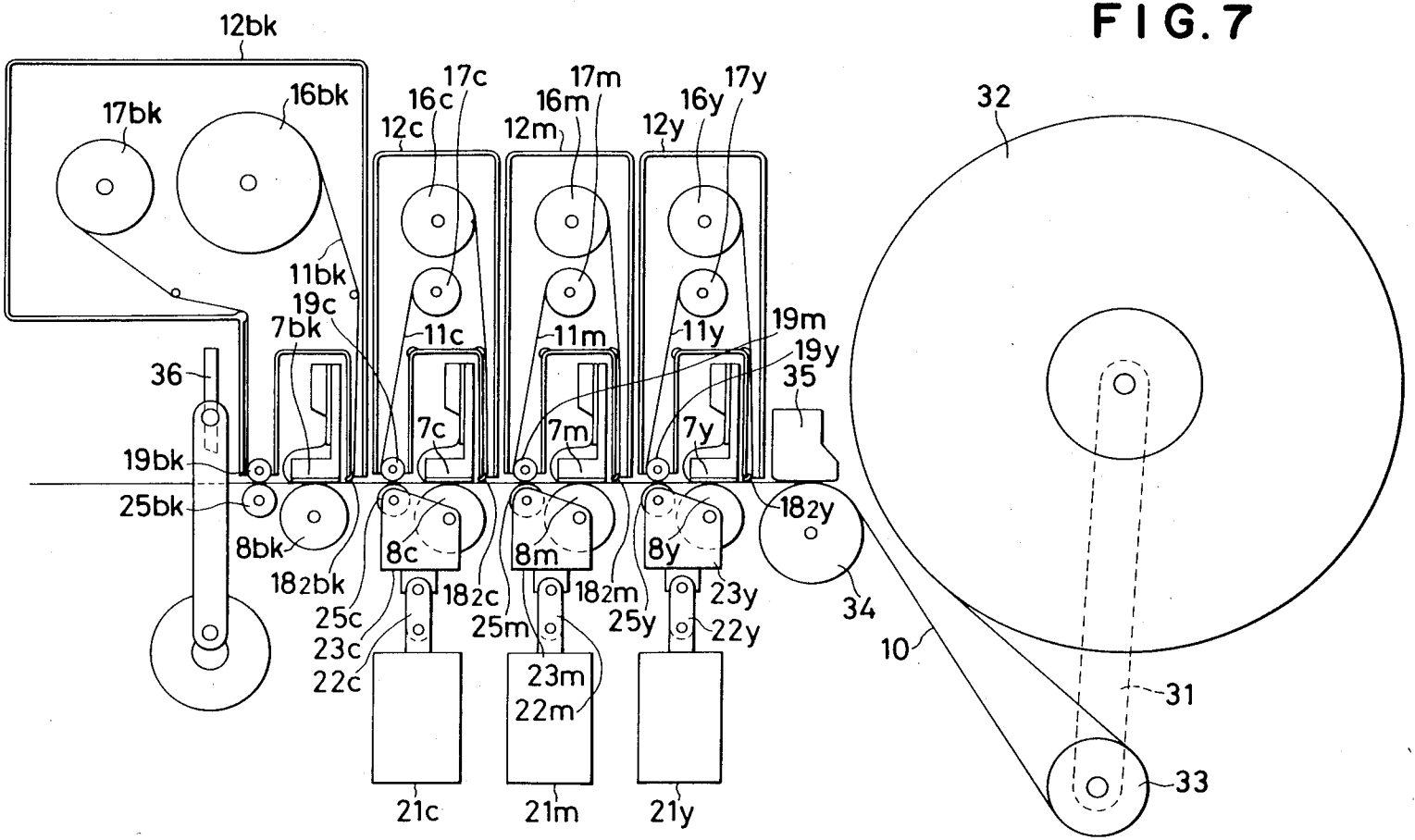
FIG. 7 is an explanatory view of an example in which the thermal head shown in FIG. 4 is applied to a multicolor thermal transfer printer.

This case will be described with reference to FIG. 7. FIG. 7 illustrates a thermal printer which uses a thermal head in accordance with the present invention, wherein thermal transfer sheets of four colors, yellow, magenta, cyan and black, are used to carry out multicolor recording.

Thermal heads 7 are provided one for each color, and in the illustrated embodiment, four thermal heads are provided because four colors are used. For the printing mechanism, a yellow recording unit, which is the foremost recording unit, will be described for the convenience's sake of explanation, but other recording units have a similar construction. The thermal head 7*y* linearly has a number of heating elements 4 widthwise of the recording paper 10 as shown in FIG. 4. The heating elements are selectively heated in response to the information recording signal from the control circuit 5 to transfer ink of a thermal transfer sheet 11*y* to the recording paper thereby recording information. The thermal transfer sheets are of the cassette type for each color, and a cassette 12*y* houses therein a thermal transfer sheet drawing-out roll 16*y*, a winding roll 17*y*, a guide roller 19*y* and the like. As shown in FIG. 7, both the rolls 16*y* and 17*y* are disposed at the upper portion in the cassette 12*y*, and the lower portion of the cassette 12*y* has a central portion thereof formed into a recessed and depressed shape, the thermal transfer sheet 11*y* being passed over a guide corner $18_{2y}$ and the guide roller 19*y* and being exposed thereto.

The above-described cassette 12*y* is set by inserting it into the apparatus from the side thereof in a direction perpendicular to the paper surface in FIG. 7. The thermal head 7*y* is fitted into the recess of the cassette 12*y*, and the exposed portion of the thermal transfer sheet 11$y$ comes into contact with a bottom surface of the thermal head (that is, a heating surface).

A platen roller 8$y$ is provided to press the thermal transfer sheet 11$y$ and recording paper 10 against the heating surface of the thermal head 7$y$ for transfer, and is rotatably mounted on a retaining member 23$y$ together with a feed roller 25$y$ opposed to the guide roller 19$y$.

The retaining member 23$y$ is mounted on a sliding shaft 22$y$ of a solenoid 21$y$, and the platen roller 8$y$ is moved up and down by turning ON-OFF the solenoid to reciprocate the thermal transfer sheet 11$y$ and recording paper 10 between a position wherein it is pressed against the thermal head 7$y$ and a position wherein there is a gap relative to the thermal head 7$y$ to release pressing.

In the illustrated embodiment, a platen roller $\mathbf{8}_{bk}$ corresponding to a cassette $\mathbf{12}_{bk}$ including a black thermal transfer sheet $\mathbf{11}_{bk}$ and a feed roller $\mathbf{25}_{bk}$, which are often used and set so as to travel together with the recording paper at all times, are locked at a position wherein the thermal transfer sheet $\mathbf{11}_{bk}$ and recording paper 10 are pressed against a thermal head $\mathbf{7}_{bk}$ and a guide roller $\mathbf{19}_{bk}$ at constant pressure.

Here, the recording paper 10 is guided from a drawing-out roll 32 to a guide roll 34 through a tension roll 33 supported on an arm 31, passes between the aforesaid thermal heads of respective colors and travels in close contact with the thermal transfer sheet at the transfer position.

In the illustrated embodiment, cut marks are premarked on the recording paper 10, and the marks are detected by a cut mark sensor 35 provided opposedly of the guide roller 34, whereby the recording paper is cut by a cutter 36 provided at an outlet of a transfer and recording block in accordance with the sensed signal to obtain a product having a predetermined length applied with a record of information resulting from transfer.

Thermal transfer sheets of three colors, yellow, magenta and cyan are set so that they are repeatedly run and stopped in accordance with control signals, which will be described later.

That is, the drawing-out roll and winding roll are rotatably driven to feed a thermal transfer sheet in synchronism with the feed speed of the recording paper by a feed roll 19$y$. However, wherein for each color, if there is present no information transfer recording signal and recording is not to be made, means for braking each roll, for example, an electromagnetic clutch, is provided on a driving shaft of each roll to stop the travelling of the thermal transfer sheet.

Figure 9:
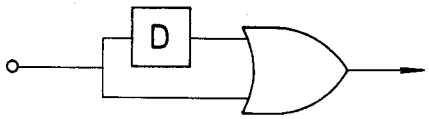
Figure 10:
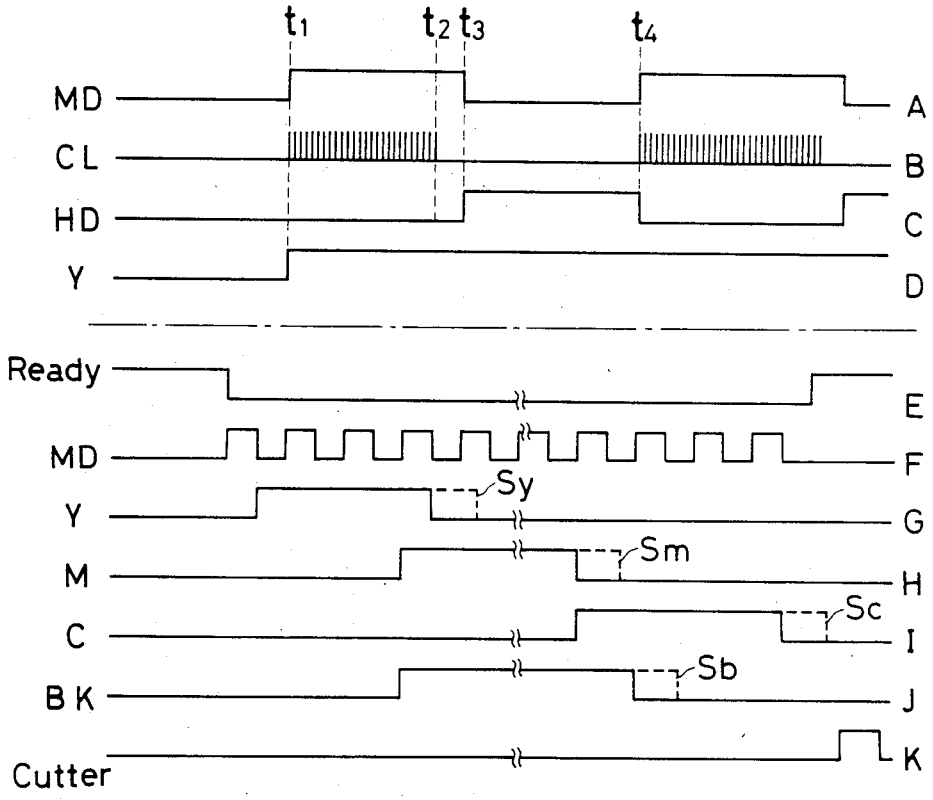
FIG. 10 is a time chart of signals in the block diagrams shown in FIGS. 8 and 9.

Next, an electrical structure of the thermal printer will be described with reference to FIGS. 8 to 10.

Figure 8:
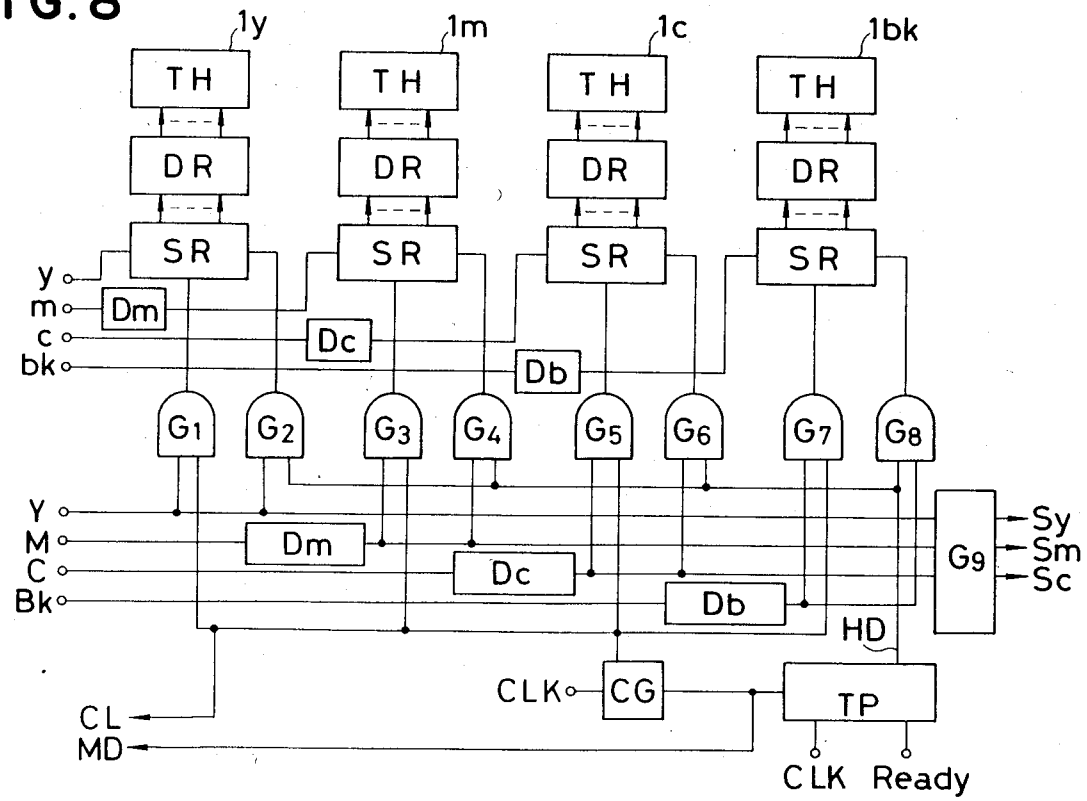
FIGS. 8 and 9 are respectively block diagrams showing an electric circuit of the apparatus shown in FIG. 6.

In FIG. 8, printing signals which indicate at what position on the recording paper printing is made are put, in four colors, yellow, magenta, cyan and black, into terminals Y, M, C and $B_k$. Dot information as to characters or patterns to be printed are put into terminals y, m, c and $b_k$ from a memory or a character generator not shown. A synchronizing clock pulse is put into a CLK terminal, and a signal for placing the present printer in an input-wait state is put into a Ready terminal.

Reference character TP designates a timing pulse generator, SR a shift register for retaining bit information for each color, DR a thermal head driving circuit, and TH a thermal head. Reference characters $D_m$, $D_c$ and $D_b$ respectively designate delay circuits having a predetermined delay. A reference character $G_9$ designates a circuit in which a GATE circuit shown in FIG. 9 is constructed with respect to respective input and outputs. Output MD designates a pulse for driving and controlling a stepping motor, CL a synchronizing pulse for reading data into the shift register, and Sy, Sm and Sc solenoid controlling outputs.

A flow of signals in the electric circuit constructed as described above will be described with reference to FIG. 10. A print start signal is obtained by releasing the Ready signal, and at the same time, a pulse MD for controlling the driving the stepping motor is generated by the timing pulse generator TP, and the recording paper is delivered by the stepping motor. At the same time, a pulse for reading dot information into the shift register as shown in FIG. 10 is generated from CG. When the recording paper is fed to a printing position, printing signals are generated in the printing signal terminals Y, M, C and $B_k$. This signal is fed to the solenoid control signal terminal to drive a solenoid 21 for controlling the pressing of the platen roller to move the latter in a direction of the heating surface of the thermal head. As a consequence, the recording paper and thermal transfer sheet are transported at the same speed while being placed in close contact with each other. At the same time, printing signals are applied to AND gates $G_1$, $G_3$, $G_5$ and $G_7$ to apply said dot information reading pulses to shift registers $SR_y$, $SR_m$, $SR_c$ and $SR_b$ and dot information of the predetermined number of dots are read from the dot information terminals y, m, c and $b_k$. At time $t_2$, reading is terminated and at $t_3$, the driving control pulse MD is turned OFF, whereby the stepping motor and the thermal transfer sheet in close contact therewith stop. At the same time, the signal HD shown in FIG. 10 is supplied to the shift registers $SR_y$, $SR_m$, $SR_c$ and $SR_b$ through the GATE circuits $G_2$, $G_4$, $G_6$ and $G_8$, whereby the dot information stored in the shift registers are supplied to thermal head driving circuits $DR_y$—$DR_b$, and the heating elements of the thermal head are heated or not heated in accordance with said dot information, as a consequence of which the required information is recorded on the recording paper from the thermal transfer sheet. When transferring is terminated at time $t_4$, the driving pulse MD is generated and the recording paper and thermal transfer sheet in close contact therewith are fed by one dot portion. At the same time, dot information on the next line is newly read into the shift register by the pulse CL. Thereafter, recording is similarly carried out while the printing signals Y, M, C and $B_k$ are present.

As shown in FIG. 7, in this apparatus, after transferring has been carried out by the respective thermal heads $\mathbf{7}_y$, $\mathbf{7}_m$, $\mathbf{7}_c$ and $\mathbf{7}_{bk}$, the thermal transfer sheets $\mathbf{11}_y$, $\mathbf{11}_m$, $\mathbf{11}_c$ and $\mathbf{11}_{bk}$ and the recording paper 10 are fed while being placed in close contact with each other until they arrive at the respective rollers $\mathbf{19}_y$, $\mathbf{19}_m$, $\mathbf{19}_c$ and $\mathbf{19}_{bk}$ with the quality of printing being enhanced by the provision of a cooling period. The thermal transfer sheets are separated from the recording paper at the rollers $\mathbf{19}_y$, $\mathbf{19}_m$, $\mathbf{19}_c$ and $\mathbf{19}_{bk}$. Thus, in order to feed the recording paper 10 and thermal transfer sheets $\mathbf{11}_y$, $\mathbf{11}_m$ and $\mathbf{11}_c$ during a period until the separation is made at the rollers $\mathbf{19}_y$, $\mathbf{19}_m$ and $\mathbf{19}_c$ after the printing signals Y, M, C and $B_k$ have been turned OFF, signals indicated by the dotted lines in FIGS. 10 G, H and I are then fed into solenoid control signals $S_y$–$S_c$ by the circuit as shown in detail in FIG. 8. When these signals are terminated, the platen rollers $\mathbf{8}_y$, $\mathbf{8}_m$ and $\mathbf{8}_c$ pressed against the thermal heads $7_y$, $7_m$ and $7_c$ and guide rollers $19_y$, $19_m$ and $19_c$ by the solenoid $21_y$, $21_m$ and $21_c$ are released from such pressing, and at the same time, the recording paper 10*a* and thermal transfer sheets $11_y$, $11_m$ and $11_c$ are released from close contact therebetween, whereby the thermal transfer sheets stop. When the transferring of each color has been terminated and the recording paper is fed by a predetermined length in a manner as described above, the Ready signal in FIG. 10 is generated, the generation of the driving pulse MD stops and the recording paper stops. At the same time, the motor for a cutter is driven by the pulse indicated at K in FIG. 10 to cut the recording paper to the predetermined length. Circuits $D_m$, $D_c$ and $D_b$ are connected to the printing signal terminals M, C and $B_k$ and dot information terminals m, c and $b_k$, respectively, in FIG. 8. These are delay circuits whereby since the thermal heads $7_y$, $7_m$, $7_c$, and $7_{bk}$ of yellow, magenta, cyan and black are mounted in a certain spaced relation as can be seen from FIG. 7, a supply of each data to the head is delayed by the time required to feed the recording paper thereby controlling the respective mechanisms in accordance with said delay. Additionally, it will be noted that these delay times are not necessarily placed in coincidence with the aforesaid feed time but can be suitably set to thereby deviate the printing range of each color depending on the object. A control circuit (not shown) for freely varying the delay timing can also be provided.

As described above, in the multicolor thermal transfer recording, even if a plurality of thermal heads need to be installed, the installation space for a printing mechanism per color can be made extremely small and simplified by using the thermal head in accordance with the present invention, and therefore, it is possible to realize a multicolor thermal printer which is driven at a high speed and is small in size.

Moreover, since thermal transfer sheets of various colors are accommodated in the cassettes for each color, operatability such as replacement of thermal transfer sheets is enhanced, and the thermal transfer sheet themselves are free from wrinkles, twists or the like to enhance the quality of printing.

Figure 11:
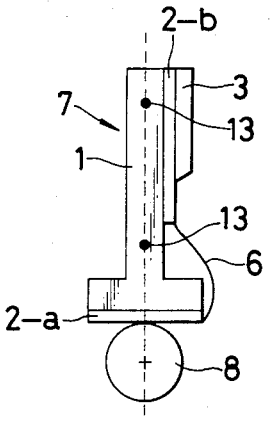
FIGS. 11 to 13 are respectively side views of a further embodiment of a thermal head in accordance with the present invention.

In the present invention, the shape of the heat sink 1 is not limited to the L-shape. The heat sink 1 can be formed into a T-shape as shown in FIG. 11 whereby pressure of the platen roller 8 and a head supporting portion 13 including bolts or the like are formed so that they are aligned on the same axis as shown by the dotted line to thereby ensure pressing of the platen roller 8 against the thermal head 7.

Figure 12:
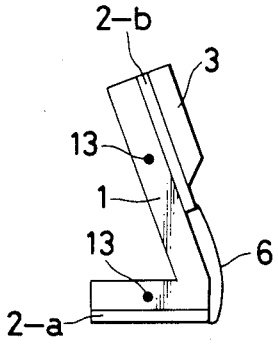

Furthermore, as shown in FIG. 12, the surface on which the substrate 2-*a* formed with the heating elements of the heat sink 1 and the substrate 2-*b* formed with the heating element control circuit are provided to not always need to have an angle of 90° but if the surface on which the substrate 2-*b* is provided is in the range of about 60° to 120° with respect to the surface on which the substrate 2-*a* is provided, the object of the present invention is sufficiently achieved.

Figure 13:
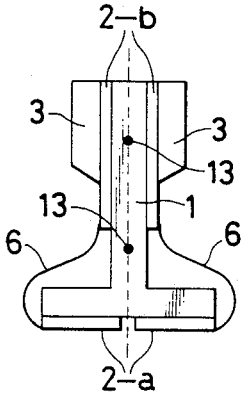

In addition, as shown in FIG. 13, the T-shaped heat sink 1 is divided into left and right sections so that the substrate 2-*a* formed with the heating elements, the substrate 2-*b* formed with the heating element control circuit and the flexible cable 6 for connecting both the substrates can be assembled at a position in symmetry with respect to left and right.

Figure 14:
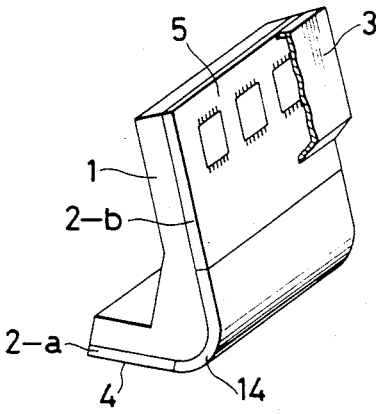
FIG. 14 is a perspective view of a still another embodiment of a thermal head in accordance with the present invention.

Moreover, the connection of the row of heating elements and the control circuit is not limited to the use of the flexible cable as shown in the above-described embodiment, but as shown in FIG. 14, wiring patterns are formed on an insulated base layer 14 provided on the heat sink 1 using conductive ink and conductive paste by a curve printing process, specifically, a transfer printing process or the like to thereby provide such connection. As a consequence, it is possible to increase the mechanical stability of the thermal head.

Furthermore, the heat sink 1 for fabricating the thermal head in accordance with the present invention will suffice to be merely formed of metal such as iron and special material need not be required. In addition, the heating element substrate 2-*a* and control circuit substrate 2-*b* need not be formed of special material but prior art substrates used for thermal heads can be used without modification and are advantageous.

With respect to the heating element control circuit forming substrate, print wiring substrates, multilayered wiring substrates and the like can be also utilized in addition to those in which a control circuit is formed on the ceramic substrate 2-*b* as shown in FIG. 4. Aslo, a so-called film carrier, in which an IC is loaded on a film formed with wiring patterns, can be used to thereby mount, in the integral form, the flexible cable 6, the control circuit substrate 2-*b* and the control circuit 5, thus enabling the construction to be simplified.

While several embodiments of the present invention have been described, it should be noted of course that the present invention is not limited to the above-described embodiments but various changes thereof can be made without departing from the spirit and purpose of the present invention.

The present invention has the construction as described above and therefore, exhibits excellent effects as described in the following.

The space required for the printing mechanism can be reduced and therefore, the whole apparatus can be easily made smaller in size. Further, the present invention is advantageous to make thermal transfer sheets or the like in the form of a cassette, and particularly, the aforementioned effects become more conspicuous if the present invention is applied to a multicolor recording apparatus.

What is claimed is:

1. A thermal print head for use with a thermal printer, comprising:

heat sink means having first and second portions;

a first substrate mounted on said first portion of said heat sink means and extending longitudinally a predetermined distance at least substantially equal to the width of a material to be printed, said first substrate defining a first plane;

a plurality of linearly arranged heating elements extending longitudinally across said first substrate so as to have a length substantially equal to said predetermined distance;

a second substrate physically distinct from said first substrate and mounted on said second portion of said heat sink means, said second substrate defining a second plane and being mounted with respect to said first substrate such that said second plane extends in a direction substantially parallel to said linearly arranged plurality of heating elements and forms an angle with said first plane in the range of from about 60 to 120 degrees; and a control circuit mounted on said second substrate for controlling said plurality of heating elements.

2. The thermal print head of claim 1, wherein said heat sink means is formed of a sheet of metal being bent to form said first and second protions with an angle therebetween in the range of from about 60 to 120 degrees.

3. The thermal print head of claim 2, wherein said heat sink means carries a print wiring pattern for connecting said plurality of heating elements to said control circuit.

4. The thermal print head of claim 1, additionally comprising a flexible cable for connecting said plurality of heating elements to said control circuit.

5. The thermal print head of claim 1, wherein said first and second substrates carry a print wiring pattern for connecting said plurality of heating elements to said control circuit.

6. The thermal print head of claim 1, additionally comprising a third substrate extending longitudinally a predetermined distance at least substantially equal to the width of a material to be printed, said third substrate mounted so as to lie substantially in said first plane, a second plurality of linearly arranged heating elements extending longitudinally across said third substrate so as to have a length substantially equal to said predetermined distance, a second control circuit for controlling said second plurality of heating elements, and a fourth substrate carrying said second control circuit, said fourth substrate defining a third plane and being mounted with respect to said third substrate such that said third plane extends in a direction substantially parallel to said linearly arranged second plurality of heating elements and forms an angle with said first plane in the range of from about 60 to 120 degrees.

7. The thermal print head of claim 6, wherein said first and third substrates and said second and fourth substrates are disposed about a central axis such that the thermal print head is symmetrical about said central axis.

8. A thermal printer, comprising:

heat sink means having first and second portions;

a first substrate mounted on said first portion of said heat sink means and extending longitudinally a predetermined distance at least substantially equal to the width of a material to be printed, said first substrate defining a first plane;

a plurality of linearly arranged heating elements extending longitudinally across said first substrate so as to have a length substantially equal to said predetermined distance;

a control circuit for controlling said plurality of heating elements;

a second substrate physically distinct from said first substrate and carrying said control circuit, said second substrate mounted on said second portion of said heat sink means, defining a second plane, and being mounted with respect to said first substrate such that said second plane extends in a direction substantially parallel to said linearly arranged plurality of heating elements and forms an angle with said first plane in the range of from about 60 to 120 degrees;

platen means located opposite said first substrate; and means for moving said platen means such that said platen means presses a material to be printed against said linearly arranged plurality of heating elements.

9. The thermal printer of claim 8 additionally comprising means for feeding a material to be printed in a direction transverse to said linearly arranged plurality of heating elements.

10. The thermal printer of claim 9 additionally comprising means for feeding a transfer material in a direction transverse to said linearly arranged plurality of heating elements thereby enabling transfer printing.

* * * * *